United States Patent [19]

Chase

[11] 4,006,509

[45] Feb. 8, 1977

[54] MOP HOLDER

[76] Inventor: Erin O. Chase, Box 266, Seneca, Mo. 64865

[22] Filed: Oct. 28, 1975

[21] Appl. No.: 626,247

[52] U.S. Cl. ..... 15/150

[51] Int. Cl.[2] ..... A47L 13/253

[58] Field of Search ..... 15/115, 146, 147 C, 15/148, 149, 150, 154, 178, 209 D; 294/100

[56] References Cited

UNITED STATES PATENTS

| | | | |
|---|---|---|---|
| 17,877 | 7/1857 | Harris | 15/154 |
| 58,872 | 10/1866 | Morehouse | 15/150 |
| 394,069 | 12/1888 | Fortin | 15/148 |
| 1,315,900 | 9/1919 | Allen | 15/150 |
| 1,910,928 | 5/1933 | Miller | 15/154 X |

FOREIGN PATENTS OR APPLICATIONS

| | | | |
|---|---|---|---|
| A29,375 | 4/1925 | France | 15/154 |
| 518,822 | 3/1955 | Italy | 15/148 |

*Primary Examiner*—Daniel Blum
*Attorney, Agent, or Firm*—John A. Hamilton

[57] ABSTRACT

A mop holder ferrule having a locking clamp for mounting soft mopheads of string or cloth thereon, the locking clamp consisting of a stationary jaw fixed on the ferrule, a movable jaw pivoted on the ferrule for movement toward the stationary jaw and including arms adjacent the ferrule, and a locking ring encircling the handle and the arms of the movable jaw, whereby movement of the locking ring along the handle moves the movable jaw progressively closer to the stationary jaw, in order that the jaws may effectively clamp mopheads of different thicknesses therebetween.

5 Claims, 5 Drawing Figures

2
4
6
8
10
12
16
18
20
28
30
34
42
50
52
54
III
IV 2
4
6
8
16
18
20
24
26
28
30
34
42
50
52
54

2
4
6
8
10
12
14
16
18
20
24
26
28
30
34
50
IV 2
4
6
8
10
14
16
20
22
28
30
32
34
50

2
4
6
8
14
16
18
20
28
34
36
38
40
42
44
46
48

MOP HOLDER

This invention relates to new and useful improvements in mop holders, and has particular reference to a mop holders including a clamping device whereby soft mop heads, such as are commonly formed of bound bundles of string or yarn, or even of multiple layers of cloth or rags, may be operatively mounted on the holders for use as an ordinary floor mop.

Mop holders of this general type are in common usage, but all within my knowledge are subject to certain shortcomings and disadvantages, such as being relatively complicated in structure and expensive to manufacture, difficult to operate manually, since they require manual deflection of heavy springs, and lack of adjustability to hold and grip firmly mopheads of perhaps widely variable bulks and thicknesses. Generally, the result of the latter shortcoming is that a mophead for a given holder must be rather carefully standardized as to bulk and thickness. The primary object of the present invention is the provision of a mop holders which overcomes and obviates all of the above enumerated shortcomings and disadvantages of prior mop holders.

More specifically, it is the object of the present invention to provide a mop holder including a clamping device operable to grip tightly and securely hold mopheads of widely variable bulk and thickness, automatically accomodating itself to mopheads of different bulks and thicknesses, to the end that virtually any mophead commonly available may be used, or even an impromptu bundle of cloth or rags. Generally, this object is accomplished by the provision of a clamping device having a ferrule permanently mounted on the mop handle and forming a part thereof, consisting of a stationary jaw affixed to the ferrule, a movable jaw pivoted to the ferrule at a point remote from the jaws by means of arms extending alongside said ferrule, and a specially configurated locking ring encircling said ferrule and the arms of said movable jaw, whereby movement of said locking ring along said ferrule pivots said movable jaw progressively closer to the stationary jaw to clamp a mophead therebetween. Means are provided for releasably securing the locking ring at any desired position, depending on the bulk and thickness of the mophead.

Other objects are simplicity and economy of construction, and efficiency and dependability of operation.

Figure 1:
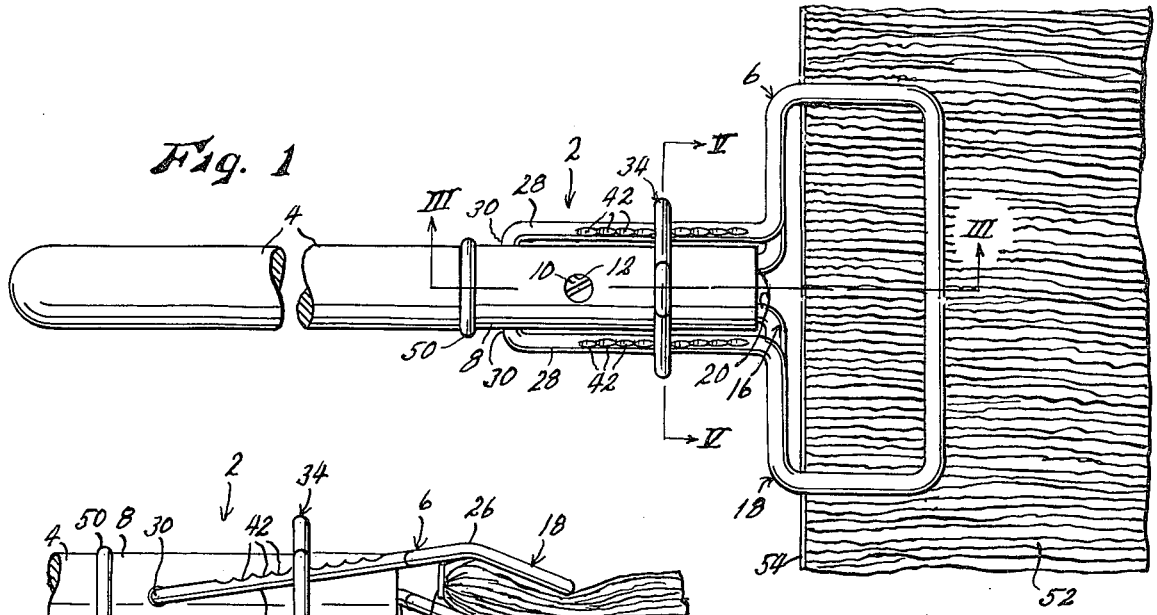
Figure 2:
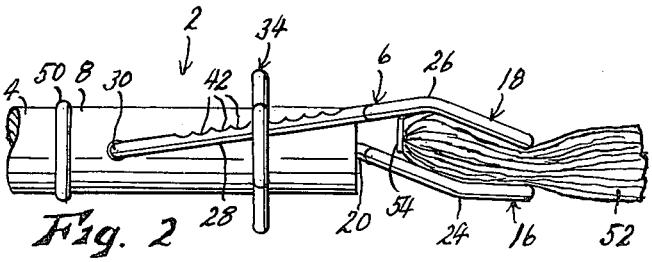
Figure 3:
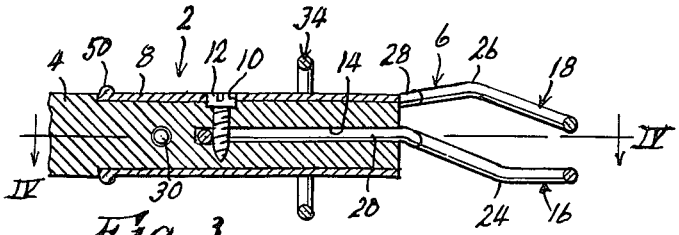
Figure 4:
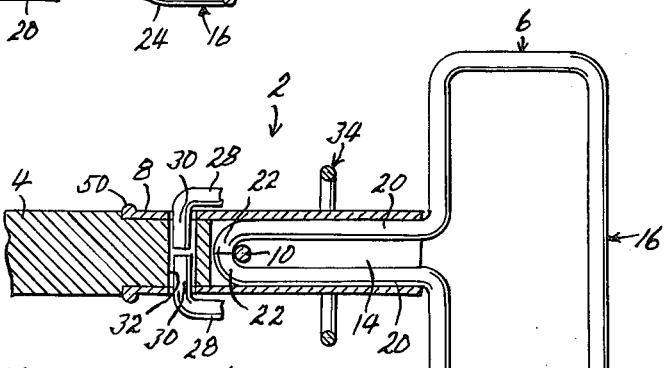
Figure 5:
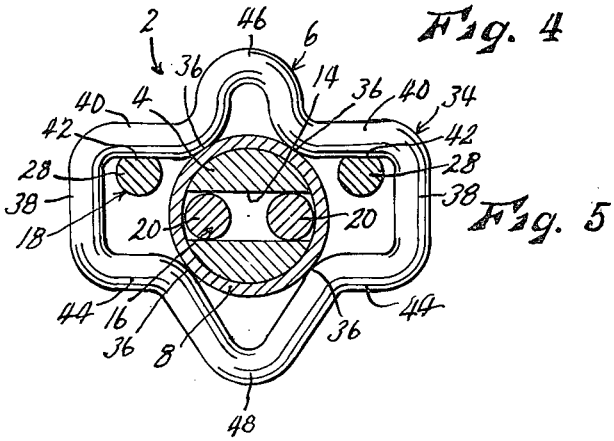

With these objects in view, as well as other objects which will appear in the course of the specification, reference will be had to the accompanying drawing, wherein:

FIG. 1 is a top plan view, partially broken away and foreshortened, of a mop holder embodying the present invention, showing a mophead operatively mounted therein, FIG. 2 is a fragmentary side elevational view of the mop holder and mophead shown in FIG. 1, FIG. 3 is a fragmentary sectional view taken on line III—III of FIG. 1, FIG. 4 is a framgentary sectional view taken on line IV—IV of FIG. 3, and FIG. 5 is an enlarged sectional view taken on line V—V of FIG. 1, showing the configuration of the locking ring.

Like reference numerals apply to similar parts throughout the several views, and the numeral 2 applies generally to the mop holder forming the subject matter of the present invention, said mop holder consisting of a handle staff 4, which is usually formed of wood but which may be of any suitable material, and which may be of any desired length, and a clamping device indicated generally by the numeral 6.

Clamping device 6 includes a tubular metal ferrule 8 fitted snugly over the lower end portion of staff 4 and secured thereto by means of a wood screw 10 inserted transversely of the staff through a snugly fitting hole 12 formed in the ferrule, and threaded into the staff. Said screw is disposed intermediate the ends of the ferrule, and projects through a diametrical slot 14 formed in the staff, said slot extending from the lower end of the staff to a point spaced upwardly from screw 10.

Clamping device 6 also includes a stationary jaw 16 and a movable jaw 18, each formed of a single length of heavy but resilient steel wire. As best shown in FIG. 4, stationary jaw 16 is disposed at the lower end of staff 4 and is of rectangular form, having its major axis disposed transversely to the staff. At the midpoint of its rearward edge, the wire of which it is formed is bent to form two parallel, transversely spaced apart arms 20 which project into slot 14 of the staff. Said arms are closely confined in ferrule 8, and at their extreme rearward ends are bent to engage behind screw 10, as indicated at 22. Thus screw 10 serves both to secure ferrule 8 on staff 4, and also to affix stationary jaw 16 to the staff and ferrule. The generally rectangular contour of jaw 16 is altered by bending the end reaches thereof to an upwardly opening wide V-form, as indicated at 24 in FIGS. 2 and 3.

Movable jaw 18 is also generally rectangular, overlying fixed jaw 16 in generally coinciding relationship therewith, and its end reaches are bent to a downwardly opening wide V-form, as indicated at 26 in FIGS. 2 and 3. At the midpoint of its rearward edge, the wire of which jaw 18 is formed is bent rearwardly to form a pair of parallel, transversely spaced arms 28 which are spaced apart by a distance slightly greater than the external diameter of ferrule 8, and extend rearwardly at opposite sides of said ferrule, The extreme rearward end portions of arms 28 are bent inwardly to form coaxial pintles 30 which are engaged pivotally in a hole 32 formed transversely through staff 4 and ferrule 8, as best shown in FIG. 4. Said pintles are disposed rearwardly of slot 14 of the staff, but are spaced forwardly from the rearward end of the ferrule.

A locking ring indicated generally by the numeral 34 encircles ferrule 8 and arms 28 of movable jaw 18. Said locking ring is also formed of heavy wire, formed in a closed loop with a configuration best shown in FIG. 5. As will be seen, said locking ring has sliding contact with ferrule 8 at four angularly spaced points 26, whereby to prevent displacement of said ring laterally of the ferrule in any direction, but is outwardly offset from said ferrule intermediate each adjacent pair of points 36, at the top, bottom and both sides of the ferrule. Each side offset 38 of the ring encloses one of arms 28 of the movable jaw, the top reaches 40 of said offsets being coaxial and extending transversely of the ferrule. These top reaches are engageable releasably in any one of a series of shallow, rounded notches 42 formed in the upper surface of the associated arms 28. The lower reaches 44 of side offsets 38 are spaced sufficiently below top reaches 40 that they cannot interfere with pivotal movement of arms 28. The top offset 46 and bottom offset 48 of ring 34 constitute finger tabs by means of which said ring may be moved manually along the ferrule. The locking ring may be moved rearwardly of pintles 30, so as not to interfere with pivotal movement of arms 28, but is held in assembly with the ferrule by a peripheral, enlarged stop rib 50 formed on the ferrule at its extreme rearward end.

In operation, the user first pulls locking ring 34 rearwardly against stop rib 50, in which position it is completely out of engagement with arms 28 of jaw 18, and jaw 18 may be freely pivoted away from jaw 16. A mophead 52 is then inserted between the jaws. As shown, mophead 52 constitutes a generally flat bundle of lengths of string or yarn, arranged generally coextensively and bound together across the transverse midline of the bundle by a binding strip 54 stitched thereto. The bundle of strands is folded along the binding strip, and the fold inserted between jaws 16 and 18 as shown. The mop handle will also accept soft mopheads of any ordinary type, or even a mophead consisting simply of folded multiple layers of cloths or rags.

The user then presses movable jaw 18 firmly toward jaw 16 to press the mophead between said jaws, and slides locking ring 34 forwardly into engagement with arms 28 of jaw 18, as best shown in FIGS. 1 and 2. Said arms are engaged by top reaches 40 of side offsets 38 of said locking ring, and pivoted thereby to move jaw 18 toward jaw 16, said relative jaw movement being progressively greater as locking ring 34 is moved farther forwardly. Said ring is moved forwardly until mophead 52 is gripped between the jaws with the desired degree of force. Movement of the locking ring may be facilitated by gripping the jaws, through the mophead, and manually moving them closer together with the fingers of one hand, while forcing ring 34 forwardly with the fingers of the other hand, using offsets 46 and 48 of the ring as finger tabs for this purpose. Reaches 40 of the locking ring will then be engaged in corresponding notches 42 of arms 28 of jaw 18, and the ring is thereby releasably secured against accidental rearward slippage on ferrule 8, which otherwise might be aused by accidental blows thereon, vibration, or the like, and which could result in accidental release of the mophead. Since jaw 18 and its arms 28 are formed of wire possessing a degree of resilience, arms 28 will be bowed or flexed downwardly, as viewed in FIG. 2, by the pressure of the locking ring thereagainst. This flexure of arms 28 serves both to maintain resilient pressure between the jaws, and also to maintain engagement between notches 42 of the arms and reaches 40 of the ring. It will be noted also that the locking ring is freely rotatable on ferrule 8, since it has only sliding contact therewith at points 36. This rotatability of the ring insures that it will exert equal jaw-closing pressure on both or arms 28, and this in turn tends strongly to insure that mophead 52 will be gripped with uniform pressure across the full width of the jaws, despite small inaccuracies or normal jaw spacing across their width which could result from manufacturing tolerances and variations. The confronting V-formation of the jaws, in a plane parallel to the staff, as provided by bends 24 and 26, provides extra spacing between said jaws, rearwardly of their forward edges, for accomodating the extra bulk of the mophead which results from folding and binding thereof at binding strip 54, or from the folding of cloth layers if that type of mophead is used. It would be extremely difficult to pull this extra folded bulk of the mophead outwardly between the forward edges of the jaws, and the mophead is therefore clamped in place with a high degree of security.

Thus it will be apparent that a mop holder having several advantages has been produced. It is extremely simple in structure and economical to manufacture. It will accept nearly any type of soft mophead, even impromptu, homemade mopheads formed of rags, and therefore virtually eliminates any necessity for using standardized, pre-manufactured mopheads. The mounting or removal of a mophead therefrom is a very simple operation, requiring no manual flexure of powerful springs, such requirement often in the past having resulted in the characterization of prior devices as "knuckle-busters", since the operation thereof often caused pinching, cutting or bruising of the fingers, and hands. For this very reason, that is, reluctance of workers to change mopheads when needed because of the danger of minor injury involved, many janitorial services have complained that their workers fail to change mopheads as often as they should, and hence often perform sloppy or inefficient jobs.

While I have shown and described a specific embodiment of my invention, it will be readily apparent that many minor changes of structure and operation could be made without departing from the spirit of the invention.

What I claim as new and desire to protect by Letters Patent is:

1. A mop holder comprising:

a. an elongated handle staff, b. a fixed jaw fixed to the lower end of said staff with its operative surface facing transversely of said staff, c. a movable jaw pivoted to said staff on an axis transverse to said staff and spaced upwardly from said fixed jaw, the operative surface of said pivoted jaw facing said fixed jaw and being movable toward and away from said fixed jaw, said pivoted jaw including a pair of parallel arms extending upwardly from the operative portion thereof respectively along transversely opposite sides of said staff, the upper ends of said arms being coaxially pivoted to said staff on an axis transverse to said staff, whereby pivotal movement of said arms toward parallelism with the staff moves said jaws relatively closer together to clamp a mophead therebetween, and operating means carried by said staff and operable to move said jaws closer together and to lock said jaws releasably at variable spacings therebetween, whereby mopheads of variable bulk and thickness may be clamped therebetween, said operating means comprising a closed locking ring encircling said staff and the arms of said pivoted jaw, whereby downward movement of said locking ring along said staff pivots said arms toward parallelism with said staff, said locking ring having sliding engagement with said staff at at least three generally regularly spaced points about its periphery, whereby said ring is guided relatively to said staff, and is provided at diametrically opposite regions thereof with outwardly offset portions each enclosing one of the arms of said pivoted jaw, each of said offsets having a reach engaging the associated arm and coaxial with the corresponding reach of the other offset, the common axis of said reaches being parallel to a plane established by the axes of said arms, said locking ring being rotatable on said staff.

2. A mop holder as recited in claim 1 wherein each of the arms of said pivoted jaw has a series of longitudinally spaced shallow notches formed therein along the line thereof engaged by said locking ring, said ring being selectively engageable in any corresponging pair of notches of said arms, whereby said ring is releasably secured against movement longitudinally of said staff.

3. A mop holder as recited in claim 2 wherein each of the arms of said pivoted jaw is resiliently flexible, whereby to be flexed by said locking ring as said ring is moved downwardly along said staff.

4. A mop holder as recited in claim 1 wherein said locking ring is additionally provided with outwardly offset portions serving as finger tabs for moving said ring along said staff.

5. A mop holder as recited in claim 1 with the addition of a tubular metal ferrule enclosing the lower end portion of said staff, said fixed jaw being provided with an extension projecting into a slot of said staff within said ferrule and fixed therein, wherein the arms of said pivoted jaw are pivoted to said ferrule, and disposed adjacent respectively opposite sides of said ferrule, and wherein said locking ring is mounted slidably and rotatably on said ferrule.

* * * * *